US005176436A

United States Patent [19]

Mitchell

[11] Patent Number: 5,176,436

[45] Date of Patent: Jan. 5, 1993

[54] STRAP TYPE DRAWER INTERLOCK STRUCTURE

[75] Inventor: Terry L. Mitchell, Jenison, Mich.

[73] Assignee: Quest Engineering, Ltd., Grand Rapids, Mich.

[21] Appl. No.: 795,702

[22] Filed: Oct. 21, 1991

[51] Int. Cl.[5] ..... E05C 7/06

[52] U.S. Cl. ..... 312/221; 312/217

[58] Field of Search ..... 312/216-221

[56] References Cited

U.S. PATENT DOCUMENTS 3,941,441 3/1976 Scheerhorn ..... 312/215

4,889,396 12/1989 Mitchell ..... 312/221

5,072,678 11/1991 Westwinkel ..... 312/221

*Primary Examiner*—Peter R. Brown

*Attorney, Agent, or Firm*—Miller, Morriss and Pappas

[57] ABSTRACT

A drawer interlock structure having a channel-like plural station frame supporting at each station a cam on one side of the frame and an operably connected slider movable by the cam on the other side of the frame. A trip pin is attached to each drawer and is located in the opening and closing of each drawer to operably engage the cam. As the cam moves and the slider is displaced a taut strap of flexible material is displaced against a spring force at opening of any one drawer and the spring is limited in its extension by a blocker whereby no other drawers can be opened until closure of the one opened drawer and whereby simultaneous movement of plural drawers are blocked by the limitedly blocked spring loaded strap. The withdrawal of the slider from a positive block against the cam is prevented until the single opened drawer is closed. Simple locking of the structure is by means of a lock device disabling any movement of the strap.

5 Claims, 2 Drawing Sheets

STRAP TYPE DRAWER INTERLOCK STRUCTURE

The present invention is a drawer interlock of the strap type useable in any stack of drawers or drawer-like elements, as for example, filing cabinets, drawer pedestals or the like found in office and furniture cabinetry. The invention combines three functions ordinarily regarded as requiring three separate mechanisms:

1Permits opening of only one drawer at a time by interlocking to prevent cabinet over-balance and tipping;

2. When lock is activated prevents any drawer in the stack from opening;

3. Presents selected drawer resistence to rebounding and accidental opening of any drawer when cabinet is jarred.

The keynotes in this interlock construction are extreme simplicity; minimum number of components; and installable in variously styled cabinet structures and with high precision components produced economically with improved reliability.

BACKGROUND OF THE INVENTION

Drawer interlock (devices permitting only one drawer of a stack of drawers to be opened at one time) are by no means new to the furniture industry but most prior art devices, including applicant's own prior art structures, are relatively complex to manufacture and time consuming to install. In general, the more complex the structure, the more noisy is the apparatus and the more chance there is for failure of a single component and the consequent failure of the interlock.

Closest know approaches in the prior art, to the interlocks herein, are found in the U.S. Pat. No. 3,941,441 of Douglas Scheerhorn and in the U.S. Pat. No. 4,889,396 of Terry L. Mitchell, et al. The Scheerhorn device employs a continuous cable operating by reason of slack left in the cable.

In the Scheerhorn device, upon the opening of one drawer, the other drawers are blocked by a taking up of slack in the cable. The interlock mechanisms of Scheerhorn comprise a single rotary cam adjacent to each drawer. The cable travels or runs in a segmented guide. When a drawer is opened, the cam in the open space between guide segments is activated by a catch and the catch, in moving the cam, takes up all of the available slack in the cable. Thus the cam element removes the slack and the slack is held so as to block the removal of any other drawer or drawers consequent to the lack of slack. The cam structure of Scheerhorn is complex and the installation of the cam construction requires very careful attention at assembly and placement within the cabinet served by the drawers.

The prior art of Terry L. Mitchell, et al., (supra) depends upon the movement of segmented vertically moveable elements and their manipulation and blocking or releasing of the drawer elements by their new position through intermediate cam movement.

The present device utilizes a constantly tensioned relatively non-yielding element, preferably a web strap acted upon by a slider element and the slider element responding to a separate rotary cam and the slider movement acting against a spring induced tension blocked by a rigid physical barrier and the consequence is a more positive interlock and a far simpler structure to manufacture, install and integrate with modern stacked drawer systems so that only a single drawer can be opened at a time and the entire stack limitedly resists displacement at all times and is easily locked by physical blocking of the tensioned element as by a simple key structure acting on a blocker arm.

The resultant construction of the present invention is less expensive to build, easier to install, and substantially indestructible in normal usage. The versatility and flexibility of the present invention is a substantial forward and unobvious step in drawer interlock construction.

The interlock device of Scheerhorn utilizes a slack cable and the single rotary cam requires substantial vertical space to be activated at opening of a drawer to make the slack cable taut and, in doing so, provides an uneasy rather than positive, blocking of the tendency with the cable to resist and return the rotary cam to its initial position. The consequence of the geometry of a rotating cam is to limit the movement of the cable to the difference between the length of the cord and the length of the arc created by the radius of the cam.

By contrast the present invention utilizes a compact cam thereby serving drawers of minimal depth and acts to positively shift a rectangular faced slider, first against a taut spring resistance force and after the cam turns substantially beyond ninety degrees (90°) the tension force against the slider by the strap toggles against the slider in an over-center relation. The cam holds the slider in place until the drawer is closed. The relative simplicity and positive locking of the construction of the present invention lends the device to functioning in a simple channel, such as steel, to preassembly and to installation in any file cabinet or stack of drawers as a complete module easily controlled by conventional lock means interfering positively with the spring in prevention of opening any drawer in the stack until the conventional lock enables the spring to perform.

The implications of the present improved structure are readily recognizable as the description proceeds by those who are familiar with the requirements and installational limits in furniture such as file cabinets, desk drawer pedestals and the like.

SUMMARY OF THE INVENTION

The elements of the invention include an elongate channel-like component which operationally supports cam elements, corresponding interior slider elements, a pivot bar, a lock, a spring and a flexible tensioned elongate strap which is limitedly movable in the combination construction.

These interlocks are variously attachable to cabinet structure in control of a stack of drawers or drawer-like elements. They flank the drawer stacks and extend vertically of the cam-slider elements to accommodate drawers of various depths. The drawers include a trip pin which is selectively located and the trip pin, upon opening of a drawer, rotates the cam element of that drawer and thereupon travels the slider element of that drawer transversely to a retreated position extending outboard of the channel element so that when the drawer is opened the slider element is travelled rearwardly beyond the channel flanges. The extension of the slider beyond the limits of the channel causes limited displacement in the tensioned and limitedly flexible high strength strap and the same displacement so stresses the strap as to a blocking point to prevent any movement in other of the drawers until the ever-present tension in the strap is relieved by closing the drawer element. All drawers, when closed, close against a drawer stop, not shown but a conventional part of the cabinetry, usually as the drawer engages the cabinet face. The limit of tensioned extendability accommodates the opening of only one drawer at a time. The limited tension in the strap when plural drawers are simultaneously jiggled toward an opening position prevents any opening of any of the drawers until restoration of all drawers to their closed position. The channel-like element repeats at selected intervals providing a plurality of drawer control stations and the minimal size of the cam and sliders together with selected location of the trip pin allows the flexibility of the interlock to serve a variety of drawer depths by simple relation to interval of the channel-like element stations.

An overriding lock bar activated, as by a key moving a blocker arm, selectively prevents any displacement of the strap and effectively disables any outward movement of the drawers by firmly blocking the strap in the blocked taut attitude.

DESCRIPTION OF THE PREFERRED EMBODIMENT

Figure 1:
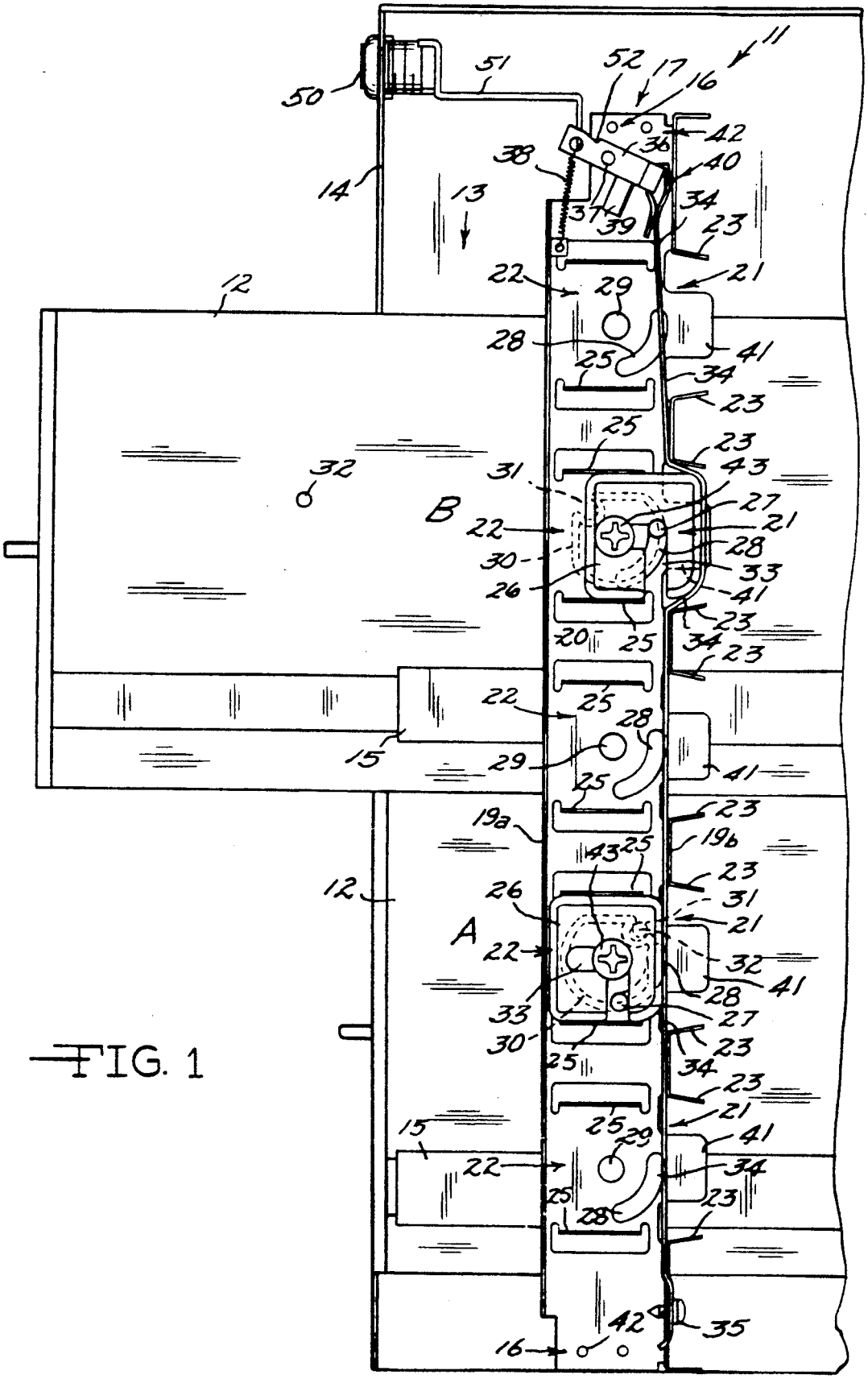
FIG. 1 is a side elevation view of the present invention in a partial side elevation of a stack of drawers in a cabinet and indicating the interlock in functioning relationship to a plurality of the drawers, the upper indicated drawer open and the lower indicated drawer closed.

Referring to the drawings, the FIG. 1 places the interlock structure 11 in a typical installation with plural drawers 12 in a stack of drawers 13 within a cabinet or drawer pedestal 14, the drawers 12 riding in typical drawer guides 15. The interlock structure 11 is seen flanking the drawers 12 and secured conveniently within the cabinet or pedestal 14 as by fastening means such as screws or welds and by other well known securing means as required.

The frame portion 17 of interlock structure 11 is an elongate channel-like element 18 having a pair of parallel spaced apart flanges **19*a* (toward drawer front) 19*b* (gapped) connected by the elongate channel web 20. One flange 19*b* (the rearmost as shown) is penetrated by plural openings 21 and the openings 21 are positioned to flank drawer interlock stations 22 and to provide outwardly splayed ramp-like shoulders 23 on the upper and lower margins of the openings 21. The ramp-like shoulders 23 are integral extensions from the flange 19*b*. Between the flanges 19*a* and 19*b*, a pair of transverse guide plates 25 extend transversely of the web 20 at intervals as shown and form guide tracks for the generally rectangular sliders 26 in a manner so as to be controlably moved from a position between the flanges 19*a* and 19*b* and against the web 20 to a physically limited extended position through the adjacent corresponding opening 21 through the wall of the flange 19*b*. The limitation is positive by means of the drive pin 27 which is limitedly moveable in the arcuate slots 28 provided through the web 20 at the intervals of the interlock stations 22. The arcuate slots 28 through which the drive pin 27 extends are on a radius from the center opening 29 which defines the axial position of the cam element 30 (shown in phantom line behind the web 20) as shown. The cam element 30 is thus positioned on the drawer side of the frame 17 so as to present an interference perimeter shoulder 31 (seen in position B) which nestably receives the projecting barrier portion or trip pin 32 of the drawer 12 as the drawer 12 is closed to position as shown at A with attendant rotation of the cam 30 with the shoulder 31 and consequent movement of the drive pin 27 radially located offset from the center of cam 30 in positive drive of the slider 26, as occurs during arcuate movement of the drive pin 27 and engagement with the rectilinear slot 33 walls provided in the slider 26. Such movement is permitted by the arcuate slot 28 which defines the extremes of movement of the drive pin 27**.

The inner side of flange **19*b* provides a guide surface for a spring taut element which is preferably a web or strap 34 of strong woven strands. The strap 34 is secured firmly as by the fastener element 35 at one end of the frame 17 as shown at the base of the frame 17. The strap 34 extends, vertically upward as shown, to connection with one end of a spring loaded rocker arm 36. The rocker arm 36 is pivotal on the pivot 37 and maintained in a constantly taut condition by a spring 38 applying tension to the rocker arm 36. Blocker means 39 is engaged against the rocker arm 36 between the pivot 37 and attachment 40 of strap 34. The rocker arms 36 is operably mounted on the channel-like frame 17 and the frame 17 is affixed to the cabinet 14 for operation in the position illustrated flanking and adjacent to the drawers 12**.

At full tension against the blocker 39 a single drawer 12 as shown can be opened against the spring force and the draw-down, as a consequence of the slider 26 being moved by the cam 30, is such as to engage the rocker arm 36 against the blocker 39.

The flanking tabular extensions 41 serve as stabilizing guides from the extended position of the sliders under the condition B of an open and opening drawer 12 and guide the straps 34 in return to the vertical position on closing the drawer 12.

The openings 42 are fastener locations and they are located through the frame 17 in accord with the styling and construction of the particular drawer support structure as exemplified by the cabinet 14. The cap screws 43 passing through the rectilinear opening passage in the slider 26 support a journal shoulder, as will be seen, that serves as a bushing for the web 20 in support of the cam 30 and as a post indexing the movement of the slider 26 as shown.

As will be appreciated the frequency and interval of the interlock stations 22 can be varied to suit particular selected numbers of drawers and drawer depth and the projecting barrier or trip pin 32 attached to the drawers 12 may be adjusted to further accommodate selected sizes and arrangements of drawers 12 adding to the flexibility and design possibilities served by interlock 11.

Figure 2:
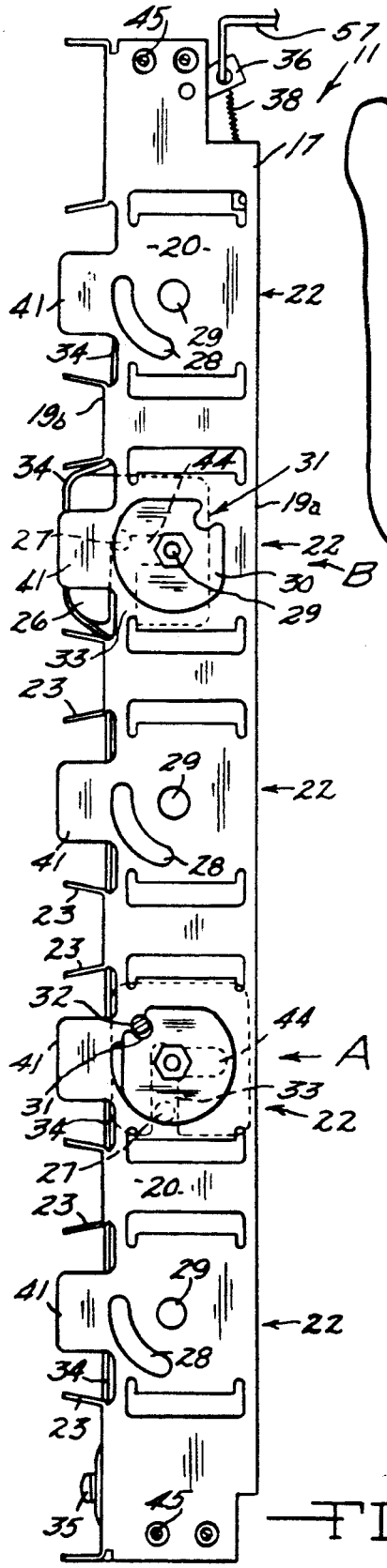
FIG. 2 is a side elevation of the interlock structure opposite from the position seen in the FIG. 1 and providing a full side elevation of the cam element which extends outside the web of the channel on the side adjacent the drawers and is actuated by the trip pin which extends from the side of each drawer to selected operating engagement with the respective cam.

In FIG. 2 the structure of FIG. 1 is turned over to reveal the cam 30 on the reverse side (the drawer side) of the web 20. When the drawer 12 (FIG. 1) is closed in situation A in the corresponding station 22, the trip pin 32 in the pocket or interference perimeter should 31 has rotated the cam 30 to the position as indicated at A and if all drawers 12 were closed then the strap 34 would be taut by the imposed tension imparted by the spring 38 along the rear wall or inner side of flange **19*b* and to open a single drawer 12 as seen in FIG. 1 the tension of the spring 38 must be overcome as the drawer 12 is withdrawn. Such withdrawal is seen in position B and the cam 30 at that station 22 is seen to have rotated so as to free the trip pin 32 from the pocket 31. This withdrawal of a drawer 12 turns the cam 30, as appreciated, and the drive pin 27 of the cam 30, projecting through the arcuate slot 28 of web 20, engages the vertical surface of the rectilinear path 33 in the slider 26 and projects the slider 26 guideable and smoothly into the tensioned strap 34 and displacing strap 34 only to the point where the rocker arm 36 engages the barrier of blocker 39 (FIG. 1). Since the strap 34 is not further extendable the situation as seen in FIG. 2 prevents any other drawer 12 from being withdrawn until such time as the respective drawer 12 served in situation B restores the condition seen in situation A. This occurs when the trip pin 32 reenters the pocket 31 and reverses the rotation of the cam 30 on its pivot and releases the positive blockage of the strap by retreating the overcenter toggle relationship of the drive pin 27, assisted by the force applied by the spring 38. The horizontal lobe 44 of the rectilinear slot 33 allows the relative horizontal shift of the slider 26 in relation to the fixed center of rotation of the cam 30 on the axis of opening 29**.

The fasteners 45, variously located to match the cabinet structure to which the interlock 11 is applied, are indicated. The tabular extensions 41 along with the ramp-like shoulders 23 guide the material of strap 34 against wear and chance distortion.

Figure 3:
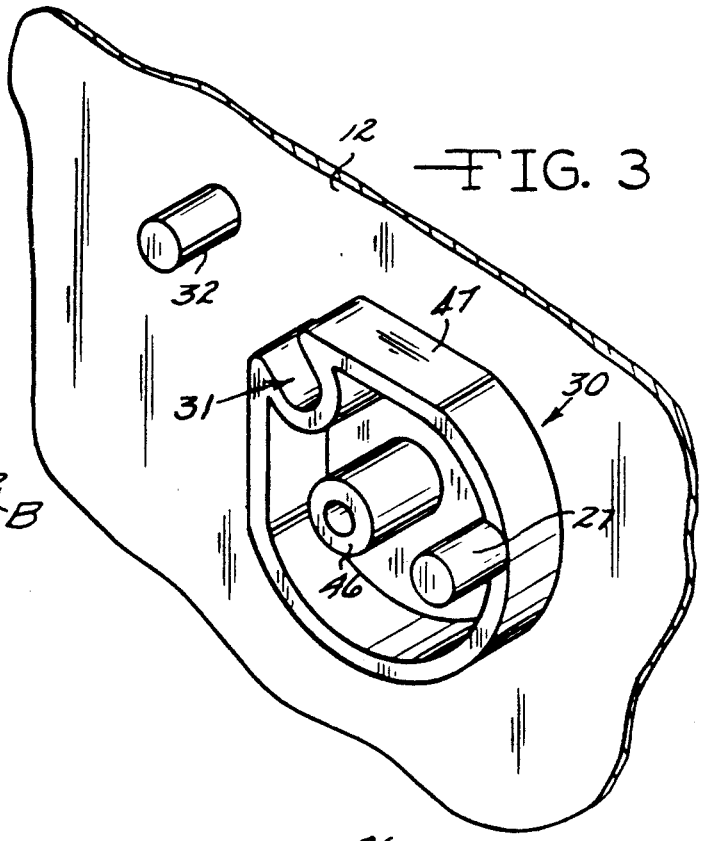
FIG. 3 is a perspective view of the cam adjacent one of the drawers and the drawer pin selectively located extending normal to the side of the drawer and thereby moving the cam as the drawer is withdrawn from the cabinet structure or stack of drawers. The cam hub or post provides the axis of the cam rotation while the perimeter drive pin of the cam is parallel and offset from the hub axis of the cam and which drive pin further extends sufficiently to penetrate the web of the channel frame and travels through an arc of movement guided by the arcuate cut-out defined through the web of the channel frame.

FIG. 3 best illustrates the form of the rotating cam 30 shown in adjacent relationship to a drawer 12 and indicates the interference path of the perimeter shoulder or pocket 31 into which the trip pin 32 enters on closure of the drawer 12 with attendant controlled rotation of the cam 30 on its post 46. The drawer 12 in the FIG. 3 has been opened. The compactness of cam 30 is easily appreciated as cylindrical on the axis of its post 46 except for the slight radially protuberant extension portion 47 in which the pocket 31 is formed.

Figure 4:
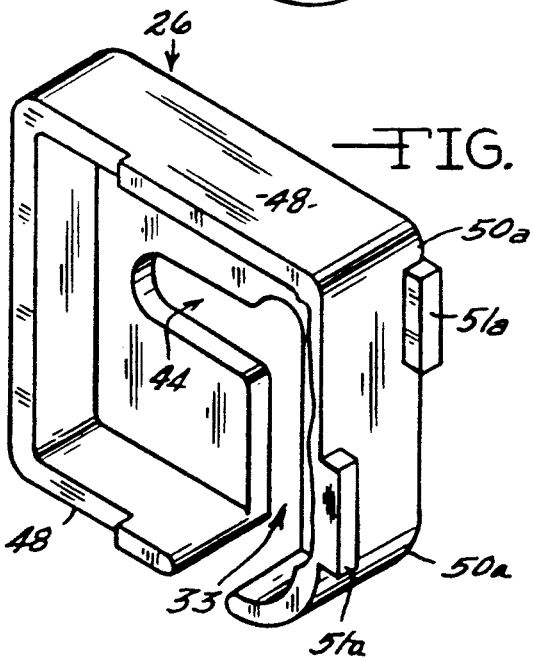
FIG. 4 is a perspective view of the slider element which moves laterally upon rotation of the cam as seen in FIG. 3 as it is moved from substantial register with the web of the channel frame to limited extension when a drawer is withdrawn and the cam rotation travelling in the arcuate track provided in the web acts upon the slider by means of the drive pin of the cam. As can be appreciated, the cam then blocks any return of the slider until the drawer being served is closed. At closure of the drawer, the accompanying cam rotation reverses the movement of the perimeter pocket and the slider is moved from a blocked positive toggle retreating the slider back into register with the web of the channel frame. The tabular extensions on the strap-engaging face of the slider maintain a guidance relationship to the tensioned strap.

In FIG. 4 slider 26 is better appreciated as generally rectilinear with a defined thickness in the planar walls 48, the outer surfaces of the walls 48 thus gliding smoothly on the transverse ways defined by the guide plates 25 shown integrally formed in the FIG. 1. The rectilinear and vertical slot 33 formed in the bottom or web portion 49 of the cam 30 includes a clear representation of the horizontal lobe portion 44. The gradually rounded corner structure **50*a* on the side of slider 26 for engagement with the strap 34 (not shown) function as shown in FIGS. 1 and 2 to smoothly engage and disengage the strap 34 against the ramp-like elements 23 (not shown). The lateral spaced apart protuberances 51*a* are spaced to control and straddle the strap 34** and prevent any chance of deformation or mislocation.

Having thus described the preferred embodiment of the interlock, the materials of construction of its elements express the simplicity and economy of its construction. The channel-like frame element 17 is preferably in metal such as steel material formed, pierced and lanced to provide an integral elongate structure as shown and described. An alternate constructive technique is to utilize a relatively rigid plastic or composite having adequate strength and otherwise substantially as described. Such a construction provides, with the plastic, steel or resin composites a quietness of performance which is desirable in office and furniture usages. The cams 30 and the sliders 26 are designed to be injection molded from resins having good wear and strength characteristics and which are dimensionally stable with a surface self lubrication such as found in the nylons and Teflon materials. The trip pin 32 may be of metal or metal with a sleeve-like cap of plastic or resin material and which can be selectively located in respect to the drawer side as by simple attachment through the drawers 12 as by threaded fasteners passing through the drawers 12 and drawing the trip pin axially into tight engagement with the drawers 12.

The strap 34 is preferred to be a resin or plastic web type with adequate strength to resist elongation and permanent deformation at the maximum stress levels likely to be encountered. However, steel strapping and even cables of stranded form in steel and Nylon are acceptable materials performing in the described manner.

The lock 50 visible in FIG. 1 selectively rotates the latch arm 51 and when all drawers 12 are closed, the spring bias of spring 38 moves the rocker arm 36 downward around the pivot 37 so that the latch arm 51 of the lock 50 can be pivoted to prevent any movement in the strap 34 and no drawers can be opened. The stark simplicity of the latch arm 50 resting in the notch 52 in the lowered rocker arm 36 will be evident to those knowledgeable in the cabinetry art.

Having thus described my interlock and its performance, others skilled in the art will perceive modifications and improvements and such modifications and improvements are intended to be included within the spirit of the present invention limited only by the scope of the appended claims.

I claim:

1. A drawer interlock structure comprising:

an elongated interlock channel having plural operational stations each with one opened side, each of said stations including raised transverse guide plates defining a track portion for each of said stations and the web portion of said channel defining a central journal opening in each of said stations between said guide plates and said web portion at each station having an arcuate slotted opening partially around said central opening;

a spring tensioned vertical strap having limited displacement and running the length of said channel and along one edge of said channel and in a path across each of the opened sides between each of said track portions of said channel and fixed to said channel at one end thereof;

a cam element pivotally journalled at each of said journal openings through said web of said channel and having a drive pin through said web rotatable in said arcuate slot of said web portion of said channel whereby said can is rotatable through an arc of about ninety degrees between full lateral extension of said drive pin and minimum extension of said drive pin; and a slider transversely and slidably movable across said channel in each selected of said stations and guided by said guide plates from a first rest position to a second extended position and said slider actuated by said drive pin to displace said strap to its limit;

a cam actuating means attached to each drawer and selectively engaging said cams through about ninety degrees of rotation upon opening said drawer whereby said cam urges said slider against said strap to release said drawer and bar all other of said drawers against removal until said first opened of said drawers is closed and said cam actuating means engages said slider and returns said slider to its rest position free of said strap.

2. In the claim 1 wherein a spring biased rocker arm connected to said strap will permit extension of said strap to allow single of said drawers to be opened at one time and thereupon blocking all others of said drawers.

3. In the claim 1 wherein a rigid bar selectively restricts movement of said strap and prevents over-extension of said strap.

4. In the claim 3 wherein lock means selectively blocks said rocker arm against any movement of said strap and disabling said spring bias by tightening said strap.

5. A drawer interlock structure for plural drawer stacks comprising:

a frame having a generally elongate channel-like configuration with a web between two flanges one of said flanges having openings at regular intervals;

spaced-apart pairs of guide plates transversely between said flanges;

a slider element having a vertical wall against said web of said frame limitedly movable on said guide plates and through said openings in said one flange and said slider having a rectilinear slot through said vertical wall of said slider;

a cam having a pivot post extending in journalled relation through said web portion in said frame and into said rectilinear opening in said slider and having a drive pin extending through said web and into an arcuate opening through said web portion of said frame and extending into said rectilinear slot in said slider, the perimeter of said cam having a pocket;

a trip pin extending from each of said drawers in interference path with said pocket in said cam, said trip pin, upon opening a selected of said drawers, rotating said cam thereby lineally displacing said slider partially through said opening in said one flange of said frame in the path of said slider, said drive pin of said cam returning said slider upon closure of said selected drawer;

and a spring tensioned strap extending substantially the length of said channel passing by and tautly closing said openings in said one flange and said slider, upon displacement by the opening of one of said drawers, moving said strap to a block position whereby other of said drawers cannot be opened except upon closure of said selected of said drawers;

and a lock means selectively preventing any movement of said strap.

* * * * *

UNITED STATES PATENT AND TRADEMARK OFFICE

CERTIFICATE OF CORRECTION

PATENT NO. : 5, 176,436
DATED : January 5, 1993
INVENTOR(S) : Terry L. Mitchell

It is certified that error appears in the above-indentified patent and that said Letters Patent is hereby corrected as shown below:

Col. 1, line 24 change "interlock" to read --- interlocks ---

Col. 5, line 24 change "should" to read --- shoulder ---

Col. 5, line 38 change "quideable" to read --quideably--

Col. 7, line 14 change "can" to read --- cam ---

Signed and Sealed this

Twenty-fifth Day of January, 1994

*Attest:*

Bruce Lehman

BRUCE LEHMAN

*Attesting Officer*

*Commissioner of Patents and Trademarks*